US009911432B2

(12) United States Patent
Kaniewska et al.

(10) Patent No.: US 9,911,432 B2
(45) Date of Patent: Mar. 6, 2018

(54) FREQUENCY BAND EXTENSION IN AN AUDIO SIGNAL DECODER

(71) Applicant: ORANGE, Paris (FR)

(72) Inventors: Magdalena Kaniewska, Louannec (FR); Stephane Ragot, Lannion (FR)

(73) Assignee: ORANGE, Paris (FR)

( * ) Notice: Subject to any disclaimer, the term of this patent is extended or adjusted under 35 U.S.C. 154(b) by 0 days.

(21) Appl. No.: 14/896,651

(22) PCT Filed: Jun. 24, 2014

(86) PCT No.: PCT/FR2014/051563
§ 371 (c)(1),
(2) Date: Dec. 7, 2015

(87) PCT Pub. No.: WO2014/207362
PCT Pub. Date: Dec. 31, 2014

(65) Prior Publication Data

US 2016/0133273 A1 May 12, 2016

(30) Foreign Application Priority Data

Jun. 25, 2013 (FR) ..... 13 56100

(51) Int. Cl.
*G10L 19/08* (2013.01)
*G10L 21/0388* (2013.01)
(Continued)

(52) U.S. Cl.
CPC ..... *G10L 21/0388* (2013.01); *G10L 19/012* (2013.01); *G10L 19/06* (2013.01);
(Continued)

(58) Field of Classification Search
CPC ..... G10L 21/038; G10L 19/08
See application file for complete search history.

(56) References Cited

U.S. PATENT DOCUMENTS 8,965,775 B2 * 2/2015 Virette ..... G10L 19/002 704/229
2002/0138268 A1 * 9/2002 Gustafsson ..... G10L 21/038 704/258

(Continued)

FOREIGN PATENT DOCUMENTS

WO 2013/066238 5/2013

OTHER PUBLICATIONS

Geiser et al. "Bandwidth Extension for Hierarchical Speech and Audio Coding in ITU-T Rec. G.729.1", IEEE Transactions on Audio, Speech, and Language Processing, vol. 15, No. 8, Nov. 2007.*

(Continued)

*Primary Examiner* — Jialong He
(74) *Attorney, Agent, or Firm* — Haverstock & Owens LLP

(57) ABSTRACT

The invention relates to a method for extending the frequency band of an audio signal during a decoding or improvement process comprising a step of decoding or extracting, in a first so-called low frequency band, an excitation signal and coefficients of a linear prediction filter. The method comprises the following steps: —obtaining a signal extended in at least a second frequency band higher than the first frequency band from an oversampled excitation signal extended in at least a second frequency band; —scaling the extended signal by means of a gain defined by subframe on the basis of an energy ratio of a frame and of a subframe; —filtering said scaled extended signal with a linear prediction filter of which the coefficients are derived from the coefficients of the low frequency band filter. The invention also relates to a frequency band extension device implementing the described method and a decoder comprising such a device.

11 Claims, 7 Drawing Sheets

(51) Int. Cl.

| | |
|---|---|
| ***G10L 21/038*** | (2013.01) |
| ***G10L 19/012*** | (2013.01) |
| ***G10L 19/06*** | (2013.01) |
| ***G10L 19/083*** | (2013.01) |
| ***G10L 19/12*** | (2013.01) |
| ***G10L 19/26*** | (2013.01) |

(52) U.S. Cl.
CPC ..... *G10L 19/083* (2013.01); *G10L 19/12* (2013.01); *G10L 19/26* (2013.01); *G10L 21/038* (2013.01); *G10L 19/08* (2013.01)

(56) References Cited

U.S. PATENT DOCUMENTS

2003/0009327 A1* 1/2003 Nilsson ..... G10L 21/038 704/219
2003/0050786 A1 3/2003 Jax et al.
2003/0093278 A1* 5/2003 Malah ..... G10L 21/038 704/265
2005/0004793 A1* 1/2005 Ojala ..... G10L 21/038 704/219
2006/0149538 A1* 7/2006 Lee ..... G10L 19/0204 704/219
2007/0033023 A1* 2/2007 Sung ..... G10L 19/24 704/229
2007/0088558 A1* 4/2007 Vos ..... G10L 19/0208 704/275
2008/0027718 A1* 1/2008 Krishnan ..... G10L 21/038 704/211
2009/0201983 A1* 8/2009 Jasiuk ..... G10L 21/038 375/240
2010/0063827 A1* 3/2010 Gao ..... G10L 21/038 704/500
2010/0114583 A1* 5/2010 Lee ..... G10L 19/025 704/500
2010/0198587 A1* 8/2010 Ramabadran ..... G10L 19/06 704/205
2012/0209599 A1* 8/2012 Malenovsky ..... G10L 19/083 704/219
2012/0239388 A1* 9/2012 Sverrisson ..... G10L 21/038 704/205
2014/0019125 A1* 1/2014 Laaksonen ..... G10L 21/038 704/205
2014/0257827 A1* 9/2014 Norvell ..... G10L 21/038 704/500

OTHER PUBLICATIONS

Ragot et al. "ITU-T G.729.1: An 8-32 KBIT/S Scalable Coder Interoperable With G.729 for Wideband Telephony and Voice Over IP", IEEE, ICASSP 2007.*
The International Search Report for the PCT/FR2014/051563 application.
Wolters M. et al., "A closer look into MPEG-4 High Efficiency AAC", Preprints of Papers presented at the aes convention, XX,XX, vol. 115, Oct. 10, 2003.
Neuendorf Max et al., "MPEG Unified Speech and Audio Coding—The ISO/MPEG Standard for High-Efficiency Audio Coding of all Content Types", AES Convention 132: Apr. 2012, AES, 60 East 42nd Street, Room 2520 New York , Apr. 26, 2012, XP040574618.

* cited by examiner

FREQUENCY BAND EXTENSION IN AN AUDIO SIGNAL DECODER

CROSS-REFERENCE TO RELATED APPLICATIONS

This Application is a Section 371 National Stage Application of International Application No. PCT/FR2014/051563, filed Jun. 24, 2014, the content of which is incorporated herein by reference in its entirety, and published as WO 2014/207362 on Dec. 31, 2014, not in English.

FIELD OF THE DISCLOSURE

The present invention relates to the field of the coding/decoding and the processing of audio frequency signals (such as speech, music or other such signals) for their transmission or their storage.

More particularly, the invention relates to a frequency band extension method and device in a decoder or a processor producing an audio frequency signal enhancement.

BACKGROUND OF THE DISCLOSURE

Numerous techniques exist for compressing (with loss) an audio frequency signal such as speech or music.

The conventional coding methods for the conversational applications are generally classified as waveform coding (PCM for "Pulse Code Modulation", ADCPM for "Adaptive Differential Pulse Code Modulation", transform coding, etc.), parametric coding (LPC for "Linear Predictive Coding", sinusoidal coding, etc.) and parametric hybrid coding with a quantization of the parameters by "analysis by synthesis" of which CELP ("Code Excited Linear Prediction") coding is the best known example.

For the non-conversational applications, the prior art for (mono) audio signal coding consists of perceptual coding by transform or in subbands, with a parametric coding of the high frequencies by band replication.

A review of the conventional speech and audio coding methods can be found in the works by W. B. Kleijn and K. K. Paliwal (eds.), Speech Coding and Synthesis, Elsevier, 1995; M. Bosi, R. E. Goldberg, Introduction to Digital Audio Coding and Standards, Springer 2002; J. Benesty, M. M. Sondhi, Y. Huang (Eds.), Handbook of Speech Processing, Springer 2008.

The focus here is more particularly on the 3GPP standardized AMR-WB ("Adaptive Multi-Rate Wideband") codec (coder and decoder), which operates at an input/output frequency of 16 kHz and in which the signal is divided into two subbands, the low band (0-6.4 kHz) which is sampled at 12.8 kHz and coded by CELP model and the high band (6.4-7 kHz) which is reconstructed parametrically by "band extension" (or BWE, for "Bandwidth Extension") with or without additional information depending on the mode of the current frame. It can be noted here that the limitation of the coded band of the AMR-WB codec at 7 kHz is essentially linked to the fact that the frequency response in transmission of the wideband terminals was approximated at the time of standardization (ETSI/3GPP then ITU-T) according to the frequency mask defined in the standard ITU-T P.341 and more specifically by using a so-called "P341" filter defined in the standard ITU-T G.191 which cuts the frequencies above 7 kHz (this filter observes the mask defined in P.341). However, in theory, it is well known that a signal sampled at 16 kHz can have a defined audio band from 0 to 8000 Hz; the AMR-WB codec therefore introduces a limitation of the high band by comparison with the theoretical bandwidth of 8 kHz.

The 3GPP AMR-WB speech codec was standardized in 2001 mainly for the circuit mode (CS) telephony applications on GSM (2G) and UMTS (3G). This same codec was also standardized in 2003 by the ITU-T in the form of recommendation G.722.2 "Wideband coding speech at around 16 kbit/s using Adaptive Multi-Rate Wideband (AMR-WB)".

It comprises nine bit rates, called modes, from 6.6 to 23.85 kbit/s, and comprises continuous transmission mechanisms (DTX, for "Discontinuous Transmission") with voice activity detection (VAD) and comfort noise generation (CNG) from silence description frames (SID, for "Silence Insertion Descriptor"), and lost frame correction mechanisms (FEC for "Frame Erasure Concealment", sometimes called PLC, for "Packet Loss Concealment").

The details of the AMR-WB coding and decoding algorithm are not repeated here; a detailed description of this codec can be found in the 3GPP specifications (TS 26.190, 26.191, 26.192, 26.193, 26.194, 26.204) and in ITU-T-G.722.2 (and the corresponding annexes and appendix) and in the article by B. Bessette et al. entitled "The adaptive multirate wideband speech codec (AMR-WB)", IEEE Transactions on Speech and Audio Processing, vol. 10, no. 8, 2002, pp. 620-636 and the source code of the associated 3GPP and ITU-T standards.

The principle of band extension in the AMR-WB codec is fairly rudimentary. Indeed, the high band (6.4-7 kHz) is generated by shaping a white noise through a time (applied in the form of gains per sub-frame) and frequency (by the application of a linear prediction synthesis filter or LPC, for "Linear Predictive Coding") envelope. This band extension technique is illustrated in FIG. 1.

A white noise $u_{HB1}(n)$, n=0, . . . , 79 is generated at 16 kHz for each 5 ms sub-frame by linear congruential generator (block 100). This noise $u_{HB1}$, (n) is formatted in time by application of gains for each sub-frame; this operation is broken down into two processing steps (blocks 102, 106 or 109):

A first factor is computed (block 101) to set the white noise $u_{HB1}(n)$ (block 102) at a level similar to that of the excitation, u(n), n=0, . . . , 63, decoded at 12.8 kHz in the low band:

$$u_{HB2}(n) = u_{HB1}(n)\sqrt{\frac{\sum_{l=0}^{63} u(l)^2}{\sum_{l=0}^{79} u_{HB1}(l)^2}}$$

It can be noted here that the standardization of the energies is done by comparing blocks of different size (64 for u(n) and 80 for $u_{HB1}(n)$) without compensation of the differences in sampling frequencies (12.8 or 16 kHz).

The excitation in the high band is then obtained (block 106 or 109) in the form:

$$u_{HB}(n)=\hat{g}_{HB}u_{HB2}(n)$$

in which the gain $\hat{g}_{HB}$ is obtained differently depending on the bit rate. If the bit rate of the current frame is <23.85 kbit/s, the gain $\hat{g}_{HB}$ is estimated "blind" (that is to say without additional information); in this case, the block 103 filters the signal decoded in low band by a high-pass filter having a cut-off frequency at 400 Hz to obtain a signal $\hat{s}_{hp}(n)$, n=0, . . . , 63—this high-pass filter eliminates the influence of the very low frequencies which can skew the estimation made in the block 104—then the "tilt" (indicator of spectral slope) denoted $e_{tilt}$ of the signal $\hat{s}_{hp}(n)$ is computed by standardized self-correlation (block 104):

$$e_{tilt} = \frac{\sum_{n=1}^{63} \hat{s}_{hp}(n)\hat{s}_{hp}(n-1)}{\sum_{n=0}^{63} \hat{s}_{hp}(n)^2}$$

and finally, $\hat{g}_{HB}$ is computed in the form:

$$\hat{g}_{HB}=w_{SP}g_{SP}+(1-w_{SP})g_{BG}$$

in which $g_{SP}=1-e_{tilt}$ is the gain applied in the active speech (SP) frames, $g_{BG}=1.25g_{SP}$ is the gain applied in the inactive speech frames associated with a background (BG) noise and $w_{SP}$ is a weighting function which depends on the voice activity detection (VAD). It is understood that the estimation of the tilt ($e_{tilt}$) makes it possible to adapt the level of the high band as a function of the spectral nature of the signal; this estimation is particularly important when the spectral slope of the CELP decoded signal is such that the average energy decreases when the frequency increases (case of a voiced signal where $e_{tilt}$ is close to 1, therefore $g_{SP}=1-e_{tilt}$ is thus reduced). It should also be noted that the factor $\hat{g}_{HB}$ in the AMR-WB decoding is bounded to take values within the range [0.1, 1.0].

At 23.85 kbit/s, a correction information item is transmitted by the AMR-WB coder and decoded (blocks 107, 108) in order to refine the gain estimated for each sub-frame (4 bits every 5 ms, or 0.8 kbit/s).

The artificial excitation $u_{HB}(n)$ is then filtered (block 111) by an LPC synthesis filter (block 111) of transfer function $1/A_{HB}(z)$ and operating at the sampling frequency of 16 kHz. The construction of this filter depends on the bit rate of the current frame:

At 6.6 kbit/s, the filter $1/A_{HB}(z)$ is obtained by weighting by a factor $\gamma=0.9$ an LPC filter of order 20, $1/\hat{A}^{ext}(z)$, which "extrapolates" the LPC filter of order 16, $1/\hat{A}(z)$, decoded in the low band (at 12.8 kHz) the details of the extrapolation in the realm of the ISF (Imittance Spectral Frequency) parameters are described in the standard G.722.2 in section 6.3.2.1; in this case, $$1/A_{HB}(z)=1/\hat{A}^{ext}(z/\gamma)$$

at the bit rates >6.6 kbit/s, the filter $1/A_{HB}(z)$ is of order 16 and corresponds simply to:

$$1/A_{HB}(Z)=1/\hat{A}(z/\gamma)$$

in which $\gamma=0.6$. It should be noted that, in this case, the filter $1/\hat{A}(z/\gamma)$ is used at 16 kHz, which results in a spreading (by proportional transformation) of the frequency response of this filter from [0, 6.4 kHz] to [0, 8 kHz].

The result, $s_{HB}(n)$, is finally processed by a bandpass filter (block 112) of FIR ("Finite Impulse Response") type, to keep only the 6-7 kHz band; at 23.85 kbit/s, a low-pass filter also of FIR type (block 113) is added to the processing to further attenuate the frequencies above 7 kHz. The high frequency (HF) synthesis is finally added (block 130) to the low frequency (LF) synthesis obtained with the blocks 120 to 123 and resampled at 16 kHz (block 123). Thus, even if the high band extends in theory from 6.4 to 7 kHz in the AMR-WB codec, the HF synthesis is rather contained in the 6-7 kHz band before addition with the LF synthesis.

A number of drawbacks in the band extension technique of the AMR-WB codec can be identified:

The signal in the high band is a white noise formatted (by temporal gains per sub-frame, by filtering by $1/A_{HB}(z)$ and bandpass filtering), which is not a good general model of the signal in the 6.4-7 kHz band. There are, for example, very harmonic music signals for which the 6.4-7 kHz band contains sinusoidal components (or tones) and no noise (or little noise); for these signals the band extension of the AMR-WB codec greatly degrades the quality.

The low-pass filter at 7 kHz (block 113) introduces a shift of almost 1 ms between the low and high bands, which can potentially degrade the quality of certain signals by slightly desynchronizing the two bands at 23.85 kbit/s—this desynchronization can also pose problems when switching bit rate from 23.85 kbit/s to other modes.

the estimation of gains for each sub-frame (block 101, 103 to 105) is not optimal. Partly, it is based on an equalization of the "absolute" energy per sub-frame (block 101) between signals at different frequencies: artificial excitation at 16 kHz (white noise) and a signal at 12.8 kHz (decoded ACELP excitation). It can be noted in particular that this approach implicitly induces an attenuation of the high-band excitation (by a ratio 12.8/16=0.8); in fact, it will also be noted no de-emphasis is performed on the high band in the AMR-WB codec, which implicitly induces an amplification relatively close to 0.6 (which corresponds to the value of the frequency response of $1/(1-0.68z^{-1})$ at 6400 Hz). In fact, the factors of 1/0.8 and of 0.6 are compensated approximately.

Regarding speech, the 3GPP AMR-WB codec characterization tests documented in the 3GPP report TR 26.976 have shown that the mode at 23.85 kbit/s has a less good quality than at 23.05 kbit/s, its quality being in fact similar to that of the mode at 15.85 kbit/s. This shows in particular that the level of artificial HF signal has to be controlled very prudently, because the quality is degraded at 23.85 kbit/s whereas the 4 bits per frame are considered to best make it possible to approximate the energy of the original high frequencies.

The limitation of the coded band to 7 kHz results from the application of a strict model of the transmission response of the acoustic terminals (filter P.341 in the ITU-T G.191) standard. Now, for a sampling frequency of 16 kHz, the frequencies in the 7-8 kHz band remain important, particularly for the music signals, to ensure a good quality level.

The AMR-WB decoding algorithm has been improved partly with the development of the scalable ITU-T G.718 codec which was standardized in 2008.

The ITU-T G.718 standard comprises a so-called interoperable mode, for which the core coding is compatible with the G.722.2 (AMR-WB) coding at 12.65 kbit/s; furthermore, the G.718 decoder has the particular feature of being able to decode an AMR-WB/G.722.2 bit stream at all the possible bit rates of the AMR-WB codec (from 6.6 to 23.85 kbit/s).

The G.718 interoperable decoder in low delay mode (G.718-LD) is illustrated in FIG. 2. Below is a list of the improvements provided by the AMR-WB bit stream decoding functionality in the G.718 decoder, with references to FIG. 1 when necessary:

the band extension (described for example in clause 7.13.1 of Recommendation G.718, block 206) is identical to that of the AMR-WB decoder, except that the 6-7 kHz bandpass filter and $1/A_{HB}(z)$ synthesis filter(blocks 111 and 112) are in reverse order. In addition, at 23.85 kbit/s, the 4 bits transmitted per sub-frames by the AMR-WB coder are not used in the interoperable G.718 decoder; the synthesis of the high frequencies (HF) at 23.85 kbit/s is therefore identical to 23.05 kbit/s which avoids the known problem of AMR-WB decoding quality at 23.85 kbit/s. Above all, the 7 kHz low-pass filter (block 113) is not used, and the specific decoding of the 23.85 kbit/s mode is omitted (blocks 107 to 109).

A post-processing of the synthesis at 16 kHz (see clause 7.14 of G.718) is implemented in G.718 by "noise gate" in the block 208 (to "enhance" the quality of the silences by reduction of the level), high-pass filtering (block 209), low frequency post filter (called "bass posfilter") in the block 210 attenuating the cross-harmonic noise at low frequencies and a conversion to 16 bit integers with saturation control (with gain control or AGC) in the block 211.

However, the band extension in the AMR-WB and/or G.718 (interoperable mode) codecs is still limited on a number of aspects.

In particular, the synthesis of high frequencies by formatted white noise (by a temporal approach of LPC source-filter type) is a very limited model of the signal in the band of the frequencies higher than 6.4 kHz.

Only the 6.4-7 kHz band is re-synthesized artificially, whereas in practice a wider band (up to 8 kHz) is theoretically possible at the sampling frequency of 16 kHz, is which can potentially enhance the quality of the signals, if they are not pre-processed by a filter of P.341 type (50-7000 Hz) as defined in the Software Tool Library (standard G.191) of the ITU-T.

There is therefore a need to improve the band extension in a codec of AMR-WB type or an interoperable version of this codec or more generally to improve the band extension of an audio signal.

SUMMARY

The present invention improves the situation.

To this end, the invention proposes a method for extending the frequency band of an audio frequency signal in a decoding or enhancement process comprising a step of decoding or of extraction, in a first frequency band called low band, of an excitation signal and of the coefficients of a linear prediction filter. The method is such that it comprises the following steps:

- obtaining of an extended signal in at least one second frequency band higher than the first frequency band from an excitation signal oversampled and extended in the at least one second frequency band;
- scaling of the extended signal by a gain defined per sub-frame as a function of a ratio of energy per frame and sub-frame of the audio frequency signal in the first frequency band;
- filtering of said scaled extended signal by a linear prediction filter whose coefficients are derived from the coefficients of the low-band filter.

Thus, the taking into account of the excitation signal (derived from the decoding of the low band or from an extraction of the signal in low band) makes it possible to perform the band extension with a signal model more suited to certain types of signals such as the music signals.

Indeed, the excitation signal decoded or estimated in the low band comprises, in some cases, harmonics, which, when they exist, can be transposed to high frequency such that it makes it possible to ensure a certain level of harmonicity in the reconstructed high band.

The band extension according to the method therefore makes it possible to improve the quality for this type of signal.

Furthermore, the band extension according to the method is performed by first extending an excitation signal and by then applying a synthesis filtering step; this approach exploits the fact that the excitation decoded in the low band is a signal whose spectrum is relatively flat, which avoids the decoded signal whitening processes which can exist in the known band extension methods in the frequency domain in the prior art.

It will be noted that, even if the invention is motivated by the enhancement of the is quality of the band extension in the context of the interoperable AMR-WB coding, the different embodiments apply to the more general case of the band extension of an audio signal, particularly in an enhancement device performing an analysis of the audio signal to extract the parameters necessary to the band extension.

The fact of taking into account the energy at the level of the current frame and that of the sub-frame in the signal in low band (first frequency band) makes it possible to adjust the ratio between the energy per sub-frame and the energy per frame in the high band (second frequency band) and thus adjust energy ratios rather than absolute energies. This makes it possible to keep, in the high band, the same energy ratio between sub-frame and frame as in the low band, which is particularly beneficial when the energy of the sub-frames varies a lot, for example in the case of transient sounds, onsets.

The different particular embodiments mentioned below can be added independently or in combination with one another to the steps of the extension method defined above.

In one embodiment, the method further comprises a step of adaptive bandpass filtering as a function of the decoding bit rate of the current frame.

This adaptive filtering makes it possible to optimize the extended bandwidth as a function of the bit rate, and therefore the quality of the signal reconstructed after band extension. Indeed, for the low bit rates (typically at 6.6 and 8.85 kbit/s for AMR-WB), the general quality of the signal decoded in low band (by the AMR-WB codec or an interoperable version) is not very good, so it is preferable to not excessively extend the decoded band and therefore limit the band extension by adapting the frequency response of the associated bandpass filter to cover for example an approximate band of 6 to 7 kHz; this limitation is all the more advantageous because the excitation signal itself is relatively poorly coded and it is preferable not to use an excessively wide subband thereof for the extension of the high frequencies. Conversely, for the higher bit rates (12.65 kbit/s and above for AMR-WB), the quality can be enhanced with an HF synthesis covering a wider band, for example approximately from 6 to 7.7 kHz. The high limit of 7.7 kHz (instead of 8 kHz) is an exemplary embodiment, which will be able to be adjusted to values close to 7.7 kHz. This limit is here justified by the fact that the extension is done in the invention with no auxiliary information and an extension to 8 kHz (even though it is theoretically possible) could result in artifacts for particular signals. Furthermore, this limitation to 7.7 kHz takes account of the fact that, typically, the anti-aliasing filters in analog/digital conversion and the resampling filters between 16 kHz and other frequencies are not perfect and they typically introduce a rejection at the frequencies below 8 kHz.

In a possible embodiment, the method comprises a step of time-frequency transform of the excitation signal, the step of obtaining of an extended signal then being performed in the frequency domain and a step of inverse time-frequency transform of the extended signal before the scaling and filtering steps.

The implementation of the band extension (of the excitation signal) in the frequency domain makes it possible to obtain a degree of subtlety of frequency analysis that is not available with a temporal approach, and also makes it possible to have a sufficient frequency resolution to detect harmonics and transpose into high frequencies harmonics of the signal (in the low band) to enhance the quality while respecting the structure of the signal.

In a detailed embodiment, the step of generation of an oversampled and extended excitation signal is performed according to the following equation:

$$U_{HB1}(k) = \begin{cases} 0 & k = 0, \ldots, 199 \\ U(k) & k = 200, \ldots, 239 \\ U(k + \text{start_band} - 240) & k = 240, \ldots, 319 \end{cases}$$

with k being the index of the sample, $U_{HB1}$ (k) being the spectrum of the extended excitation signal, U(k) being the spectrum of the excitation signal obtained after the transform step and start_band being a predefined variable.

Thus, this function does indeed comprise a resampling of the excitation signal by adding samples to the spectrum of this signal.

In the frequency band corresponding to the samples ranging from 200 to 239, the original spectrum is retained, to be able to apply thereto a progressive attenuation response of the high-pass filter in this frequency band and also to not introduce audible defects in the step of addition of the low-frequency synthesis to the high-frequency synthesis.

In a particular embodiment, the method comprises a step of de-emphasis filtering of the extended signal at least in the second frequency band.

Thus, the signal in the second frequency band is adjusted to a domain consistent with the signal in the first frequency band.

In a particular embodiment, the method further comprises a step of generation of a noise signal at least in the second frequency band, the extended signal being obtained by combination of the extended excitation signal and of the noise signal.

Indeed, it is sufficient to have characteristics derived from the oversampled and extended excitation signal in at least one second frequency band to have a signal model suited to certain types of signals. This can be combined with another signal, for example a noise generated to obtain the extended signal having a suitable signal model.

In one embodiment, the combination step is performed by adaptive additive mixing with a level equalization gain between the extended excitation signal and the noise signal.

The application of this equalization gain makes it possible in the combination step to adapt to the characteristics of the signal to optimize the relative proportion of noise in the mix.

The present invention also targets a device for extending the frequency band of an audio frequency signal comprising a stage of decoding or of extraction, in a first frequency band called low band, of an excitation signal and of the coefficients of a linear prediction filter. The device is such that it comprises:

a module for obtaining an extended signal ($U_{HB2}$(k), 503)) in at least one second frequency band higher than the first frequency band from an excitation signal oversampled and extended in the at least one second frequency band ($U_{HB1}$(k));

a module (507) for scaling the extended signal by a gain defined per sub-frame as a function of a ratio of energy per frame and sub-frame of the audio frequency signal in the first frequency band;

a module (510) for filtering said scaled extended signal by a linear prediction filter whose coefficients are derived from the coefficients of the low-band filter.

This device offers the same advantages as the method described previously, that it implements.

The invention targets a decoder comprising a device as described.

It targets a computer program comprising code instructions for the implementation of the steps of the band extension method as described, when these instructions are executed by a processor.

Finally, the invention relates to a storage medium, that can be read by a processor, incorporated or not in a band extension device, possibly removable, storing a computer program implementing a band extension method as described previously.

BRIEF DESCRIPTION OF THE DRAWINGS

Other features and advantages of the invention will become more clearly apparent on reading the following description, given purely as a nonlimiting example and with reference to the attached drawings, in which.

DETAILED DESCRIPTION OF ILLUSTRATIVE EMBODIMENTS

Figure 2:
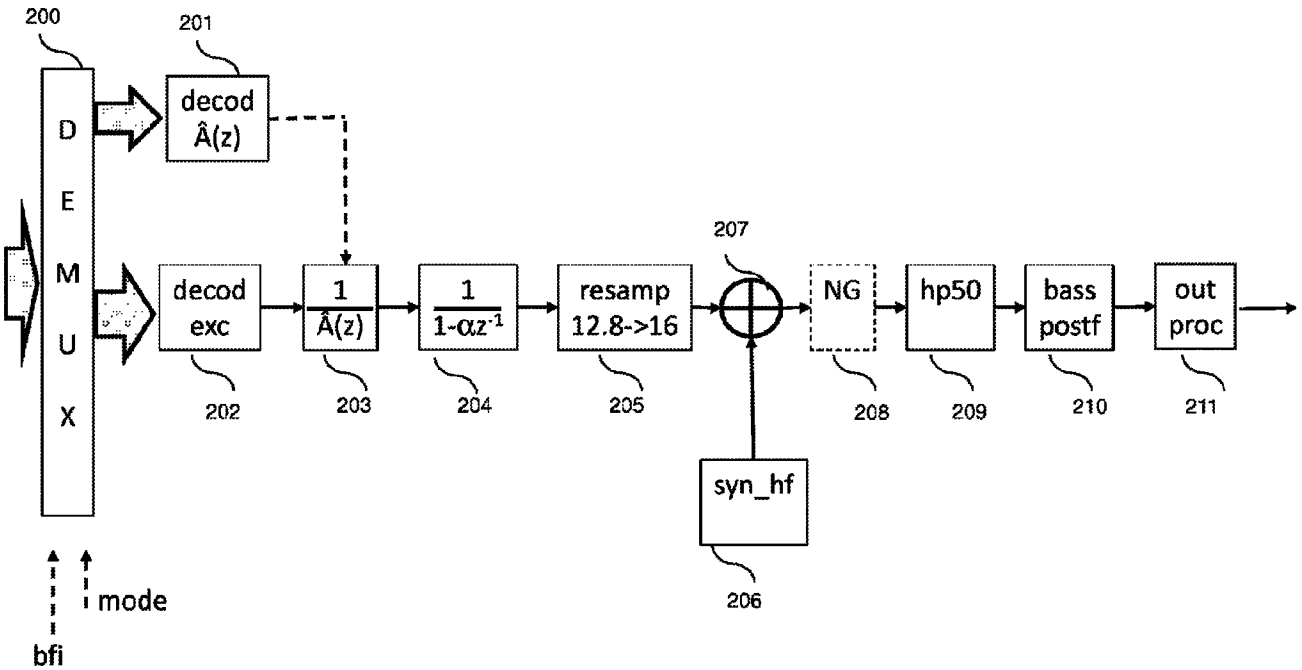
Fig.2 (Prior Art)
FIG. 2 illustrates a decoder of 16 kHz G.718-LD interoperable type according to the prior art and as described previously.
Figure 3:
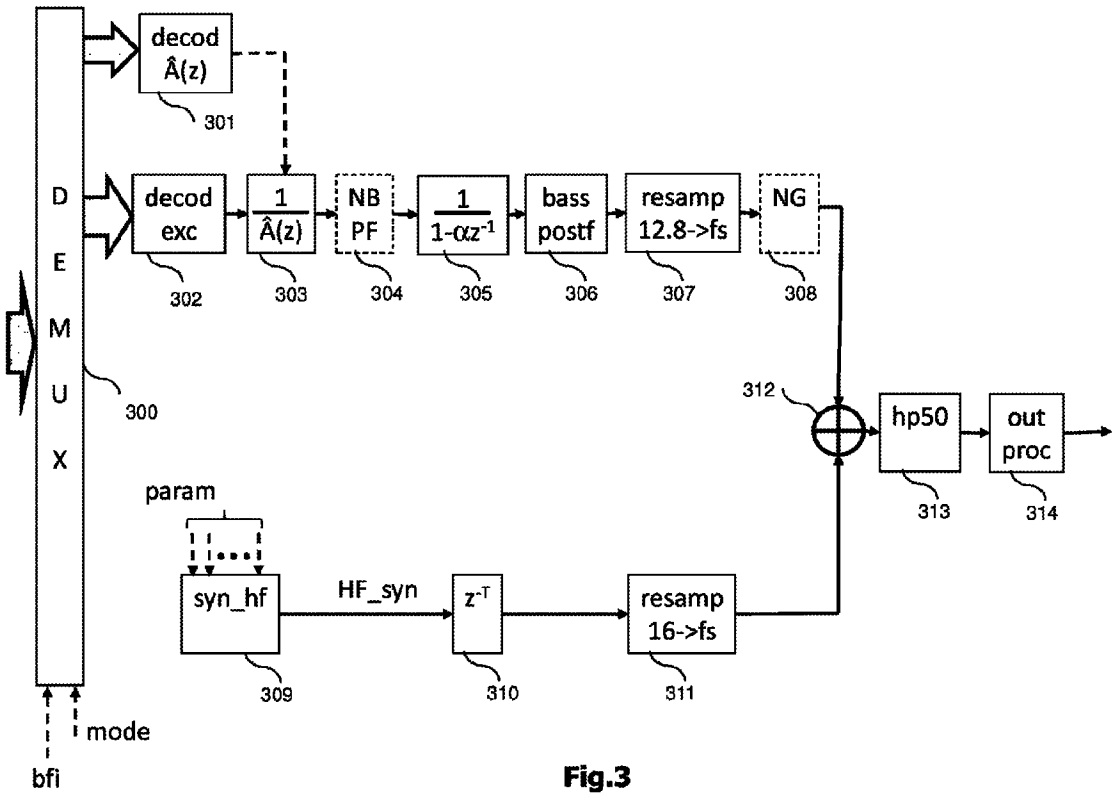
FIG. 3 illustrates a decoder that is interoperable with the AMR-WB coding, incorporating a band extension device according to an embodiment of the invention.

FIG. 3 illustrates an exemplary decoder compatible with the AMR-WB/G.722.2 standard in which there is a post-processing similar to that introduced in the G.718 and described with reference to FIG. 2 and an improved band extension according to the extension method of the invention, implemented by the band extension device illustrated by the block 309.

Unlike the AMR-WB decoding which operates with an output sampling frequency of 16 kHz and the G.718 decoder which operates at 8 or 16 kHz, a decoder is considered here which can operate with an output (synthesis) signal at the frequency fs=8, 16, 32 or 48 kHz. It should be noted that it is assumed here that the coding has been performed according to the AMR-WB algorithm with an internal frequency of 12.8 kHz for the CELP coding in low band and at 23.85 kbit/s a gain coding per sub-frame at the frequency of 16 kHz; even though the invention is described here at the decoding level, it is assumed here that the coding can also operate with an input signal at the frequency fs=8, 16, 32 or 48 kHz and suitable resampling operations, beyond the context of the invention, are implemented in coding as a function of the value of fs. It can be noted that, when fs=8 kHz, in the case of a decoding compatible with AMR-WB, it is not necessary to extend the 0-6.4 kHz low band, because the audio band reconstructed at the frequency fs is limited to 0-4000 Hz.

In FIG. 3, the CELP decoding (LF for low frequencies) still operates at the internal frequency of 12.8 kHz, as in AMR-WB and G. 718, and the band extension (HF for high frequencies) which is the subject of the invention operates at the frequency of 16 kHz, and the LF and HF syntheses are combined (block 312) at the frequency fs after suitable resampling (block 306 and internal processing in the block 311). In variants of the invention, the combining of the low and high bands can be done at 16 kHz, after having resampled the low band from 12.8 to 16 kHz, before resampling the extended signal at the frequency fs.

The decoding according to FIG. 3 depends on the AMR-WB mode (or bit rate) associated with the current frame received. As an indication, and without affecting the block 309, the decoding of the CELP part in low band comprises the following steps:

demultiplexing of the coded parameters (block 300) in the case of a frame correctly received (bfi=0 where bfi is the "bad frame indicator" with a value 0 for a frame received and 1 for a frame lost);

decoding of the ISF parameters with interpolation and conversion into LPC coefficients (block 301) as described in clause 6.1 of the standard G.722.2;

decoding of the CELP excitation (block 302), with an adaptive and fixed part for reconstructing the excitation (exc or u'(n)) in each sub-frame of length 64 at 12.8 kHz:

$$u'(n)=\hat{g}_p v(n)+\hat{g}_c c(n), n=0, \ldots, 63$$

by following the notations of clause 7.1.2.1 of G.718 concerning the CELP decoding, where v(n) and c(n) are respectively the code words of the adaptive and fixed dictionaries, and $\hat{g}_p$ and $\hat{g}_c$ are the associated decoded gains. This excitation U'(n) is used in the adaptive dictionary of the next sub-frame; it is then post-processed and, as in G.718, the excitation u'(n) (also denoted exc) is distinguished from its modified post-processed version u(n) (also denoted exc2) which serves as input for the synthesis filter, $1/\hat{A}(z)$, in the block 303; In variants which can be implemented for the invention, the post-processing operations applied to the excitation can be modified (for example, the phase dispersion can be enhanced) or these post-processing operations can be extended (for example, a reduction of the cross-harmonics noise can be implemented), without affecting the nature of the band extension method according to the invention;

synthesis filtering by $1/\hat{A}(z)$ (block 303) where the decoded LPC filter $\hat{A}(z)$ is of order 16;

narrow-band post-processing (block 304) according to clause 7.3 of G.718 if fs=8 kHz;

de-emphasis (block 305) by the filter $1/(1-0.68z^{-1})$;

post-processing of the low frequencies (block 306) as described in clause 7.14.1.1 of G.718. This processing introduces a delay which is taken into account in the decoding of the high band (>6.4 kHz);

re-sampling of the internal frequency of 12.8 kHz at the output frequency fs (block 307). A number of embodiments are possible. Without losing generality, it is considered here, by way of example, that if fs=8 or 16 kHz, the re-sampling described in clause 7.6 of G.718 is repeated here, and if fs=32 or 48 kHz, additional finite impulse response (FIR) filters are used;

computation of the parameters of the "noise gate" (block 308) which is performed preferentially as described in clause 7.14.3 of G.718.

It can be noted that the use of blocks 306, 308, 314 is optional.

It will also be noted that the decoding of the low band described above assumes a so-called "active" current frame with a bit rate between 6.6 and 23.85 kbit/s. In fact, when the DTX mode is activated, certain frames can be coded as "inactive" and in this case it is possible to either transmit a silence descriptor (on 35 bits) or transmit nothing. In particular, it will be recalled that the SID frame describes a number of parameters: ISF parameters averaged over 8 frames, average energy over 8 frames, dithering flag for the reconstruction of non-stationary noise. In all cases, in the decoder, there is the same decoding model as for an active frame, with a reconstruction of the excitation and of an LPC filter for the current frame, which makes it possible to apply the band extension even to inactive frames. The same observation applies for the decoding of "lost frames" (or FEC, PLC) in which the LPC model is applied.

Unlike the AMR-WB or G.718 decoding, the decoder according to the invention makes it possible to extend the decoded low band (50-6400 Hz taking into account the 50 Hz high-pass filtering on the decoder, 0-6400 Hz in the general case) to an extended band, the width of which varies, ranging approximately from 50-6900 Hz to 50-7700 Hz depending on the mode implemented in the current frame. It is thus possible to refer to a first frequency band of 0 to 6400 Hz and to a second frequency band of 6400 to 8000 Hz. In reality, in the preferred embodiment, the extension of the excitation is performed in the frequency domain in a 5000 to 8000 Hz band, to allow a bandpass filtering of 6000 to 6900 or 7700 Hz width.

In a preferred embodiment, at 23.85 kbit/s, as in the G.718 decoder described with reference to FIG. 2, the HF gain correction information (0.8 kbit/s) transmitted at 23.85 kbit/s is here disregarded. Thus, in FIG. 3, no block specific to 23.85 kbit/s is used.

Figure 5:
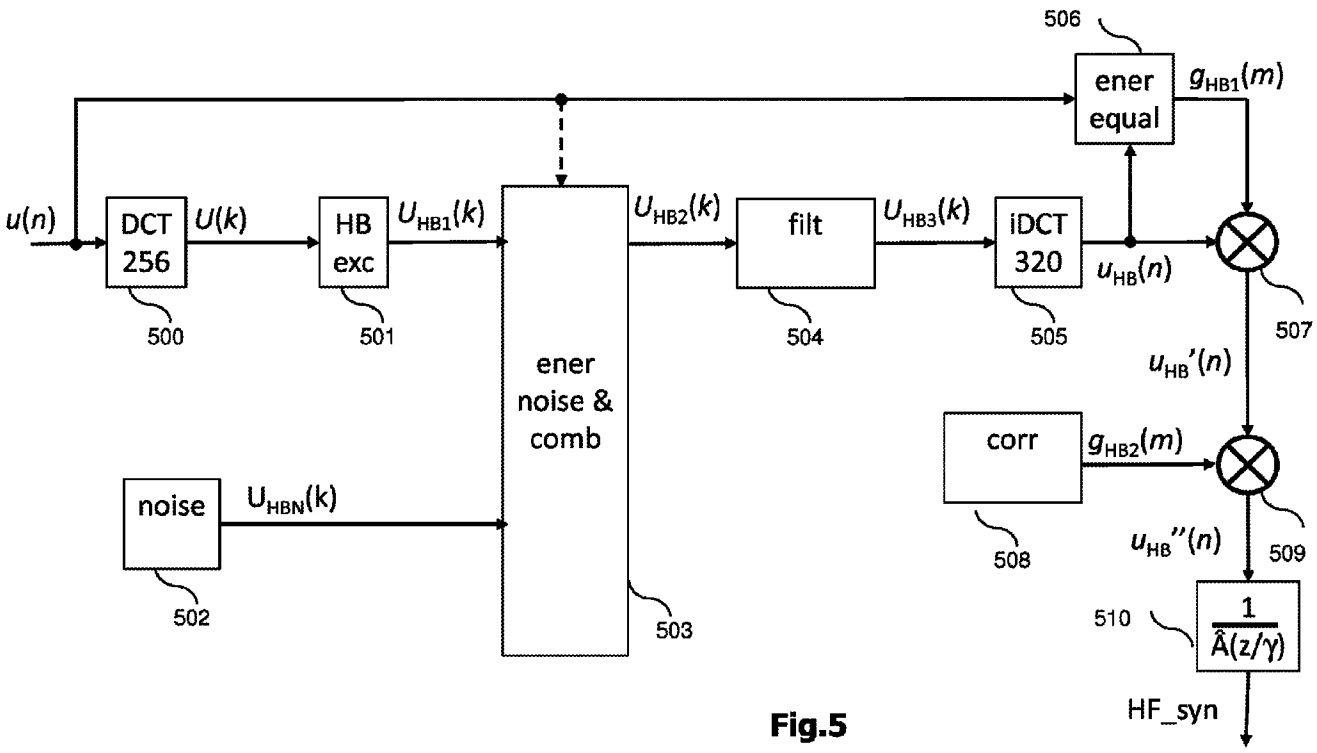
FIG. 5 illustrates a first embodiment in the frequency domain of a band extension device according to the invention.
Figure 7:
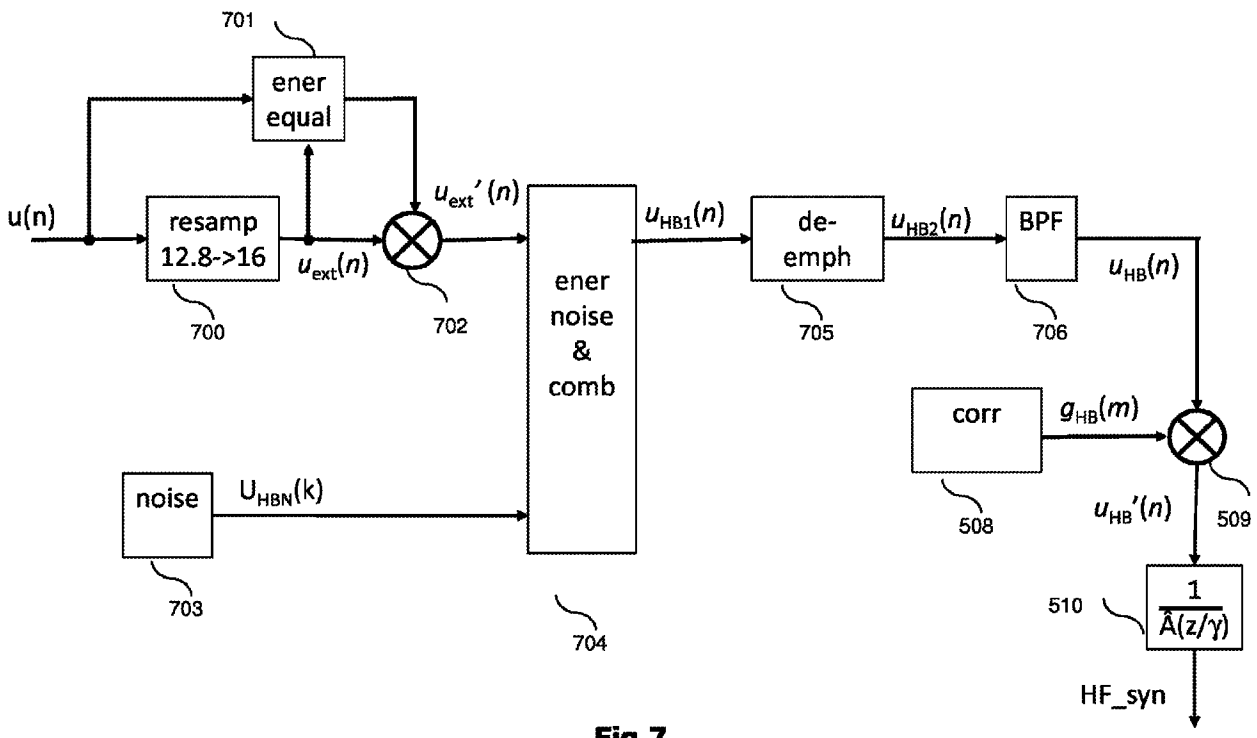
FIG. 7 illustrates a second embodiment in the time domain of a band extension device according to the invention.

The high-band decoding part is implemented in the block 309 representing the band extension device according to the invention and which is detailed in FIG. 5 in a first embodiment and in FIG. 7 in a second embodiment.

This device comprises at least one module obtaining an extended signal in at least one second frequency band higher than the first frequency band from an excitation signal oversampled and extended in at least one second frequency band ($U_{HB1}(k)$), a module for scaling the extended signal by a gain defined per sub-frame as a function of a ratio of energy per frame and sub-frame of the audio frequency signal in the first frequency band and a module for filtering said scaled extended signal by a linear prediction filter whose coefficients are derived from the coefficients of the low-band filter.

In order to align the decoded low and high bands, a delay (block 310) is introduced in the first embodiment to synchronize the outputs of the blocks 306 and 307 and the high band synthesized at 16 kHz is resampled from 16 kHz to the frequency fs (output of block 311). For example, when fs=16 kHz, the delay T=30 samples, which corresponds to the delay of resampling from 12.8 to 16 kHz of 15 samples+ delay of the post-processing of the low frequencies of 15 samples. The value of the delay T will have to be adapted for the other cases (fs=32, 48 kHz) as a function of the processing operations implemented. It will be recalled that when fs=8 kHz, it is not necessary to apply the blocks 309 to 311 because the band of the signal at the output of the decoder is limited to 0-4000 Hz.

It will be noted that the extension method of the invention implemented in the block 309 according to the first embodiment preferentially does not introduce any additional delay relative to the low band reconstructed at 12.8 kHz; however, in variants of the invention (for example by using a time/frequency transformation with overlap), a delay will be able to be introduced. Thus, generally, the value of T in the block 310 will have to be adjusted according to the specific implementation. For example, in the case where the post-processing of the low-frequencies (block 306) is not used, the delay to be introduced for fs=16 kHz will be able to be set at T=15 samples; similarly, if the invention is implemented according to the variant of the embodiment described in FIG. 7, the value of T is reduced to compensate the delay introduced by the post-processing of the low frequencies (block 306) if it is used.

The low and high bands are then combined (added) in the block 312 and the synthesis obtained is post-processed by 50 Hz high-pass filtering (of IIR type) of order 2, the coefficients of which depend on the frequency fs (block 313) and output post-processing with optional application of the "noise gate" in a manner similar to G.718 (block 314).

Figure 4:
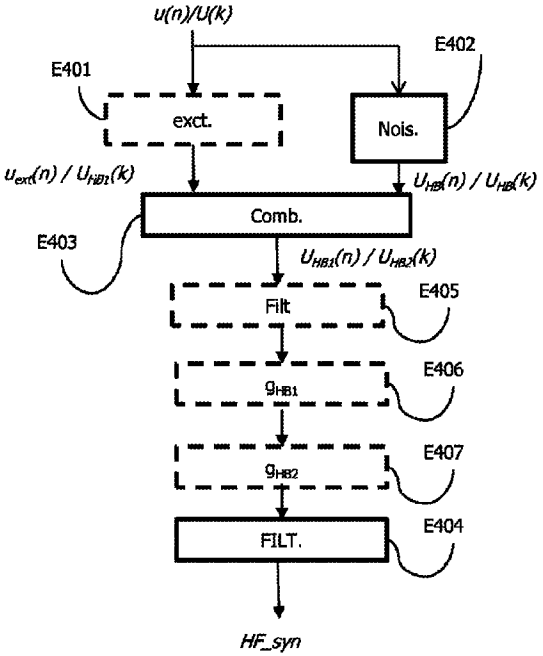
FIG. 4 illustrates, in flow diagram form, the main steps of a band extension method according to an embodiment of the invention.

The band extension device according to the invention, illustrated by the block 309 according to the embodiment of the decoder of FIG. 3, implements a band extension method described now with reference to FIG. 4.

This extension device can also be independent of the decoder and can implement the method described in FIG. 4 to perform a band extension of an existing audio signal stored or transmitted to the device, with an analysis of the audio signal to extract an excitation and an LPC filter therefrom.

This device receives as input an excitation signal in a first frequency band called low band u(n) in the case of an implementation in the time domain or U(k) in the case of an implementation in the frequency domain for which a time-frequency transform step is then applied.

In the case of an application in a decoder, this received excitation signal is a decoded signal.

In the case of an enhancement device independent of the decoder, the low-band excitation signal is extracted by analysis of the audio signal.

In one possible embodiment, the low-band audio signal is resampled before the step of extraction of the excitation, so that the excitation extracted from the audio signal by linear prediction estimated from the low-band signal (or from LPC parameters associated with the low band) is already resampled. An exemplary embodiment in this case consists in taking a low-band signal sampled at 12.8 kHz for which there is a low-band LPC filter describing the short-term spectral envelope for the current frame, oversampling it at 16 kHz, and filtering it by an LPC prediction filter obtained by extrapolating the LPC filter. Another exemplary embodiment consists in taking a low-band signal sampled at 12.8 kHz for which there is no LPC model, oversampling it at 16 kHz, performing an LPC analysis on this signal at 16 kHz, and filtering this signal by an LPC prediction filter obtained by this analysis.

A step E401 of generation of an extended oversampled excitation signal ($u_{ext}(n)$ or $U_{HB1}(k)$) in a second frequency band higher than the first frequency band is performed. This generation step can comprise both a re-sampling step and an extension step or simply an extension step as a function of the excitation signal obtained as input.

This step is detailed later in the embodiments described with reference to FIGS. 5 and 7.

This extended oversampled excitation signal is used to obtain an extended signal ($U_{HB2}(k)$) in a second frequency band. This extended signal then has a signal model suited to certain types of signals by virtue of the characteristics of the extended excitation signal.

This extended signal can be obtained after combination of the oversampled and extended excitation signal with another signal, for example a noise signal.

Thus, in one embodiment, a step E402 of generation of a noise signal ($u_{HB}(n)$ or $U_{HB}(k)$ at least in the second frequency band is performed. The second frequency band is, for example, a high-frequency band ranging from 6000 to 8000 Hz. For example, this noise can be generated in a pseudo-random manner by a linear congruential generator. In variants of the invention, it will be possible to replace this noise generation by other methods, for example it will be possible to define a signal of constant amplitude (of arbitrary value, such as 1) and apply random signs to each frequency ray generated.

The extended excitation signal is then combined with the noise signal in the step E403 to obtain the extended signal that will also be able to be called combined signal ($u_{HB1}(n)$ or $U_{HB2}(k)$) in the extended frequency band corresponding to all the frequency band including the first and the second frequency band. Thus, the combination of these two types of signals makes it possible to obtain a combined signal with characteristics more suited to certain types of signals such as music signals.

Indeed, the excitation signal decoded or estimated in the low band comprises, in certain cases, harmonics closer to music signals than the noise signal alone. The low-frequency harmonics, if they exist, can thus be transposed to high frequency such that their mixing with noise makes it possible to ensure a certain level of harmonicity or relative noise level or spectral flatness in the reconstructed high band.

The band extension according to the method enhances the quality for this type of signal compared to AMR-WB.

The combined (or extended) signal is then filtered in E404 by a linear prediction filter whose coefficients are derived from the coefficients of the low-band filter ($\hat{A}(z)$) decoded or obtained by analysis and extraction from the low-band signal or an oversampled version thereof. The band extension according to the method is therefore performed by first extending an excitation signal and by then applying a step of synthesis filtering by linear prediction (LPC); this approach exploits the fact that the LPC excitation decoded in the low band is a signal whose spectrum is relatively flat, which avoids additional decoded signal whitening processing operations in the band extension.

Advantageously, the coefficients of this filter can for example be obtained from decoded parameters of the linear prediction filter (LPC) in low band. If the LPC filter used in high band sampled at 16 kHz is of the form $1/\hat{A}(z/\gamma)$, where $1/\hat{A}(z)$ is the filter decoded in low band, and $\gamma$ a weighting factor, the frequency response of the filter $1/\hat{A}(z/\gamma)$ corresponds to a spreading of the frequency response of the filter decoded in low band. In a variant, it will be possible to extend the filter $1/\hat{A}(z)$ to a higher order (such as to 6.6 kbit/s in the block 111) to avoid such spreading.

Preferentially, but optionally, additional steps of adaptive bandpass filtering in E405 and/or of scaling in E406 and E407 can be performed to, on the one hand, enhance the quality of the extension signal according to the decoding bit rate and, on the other hand, to be sure to keep the same energy ratio between a sub-frame and a combined signal frame as in the low frequency band.

These steps will be explained in more detail in the embodiments of FIGS. 5 and 7.

In a first embodiment, the band extension device is now described with reference to FIG. 5. This device implements the band extension method described previously with reference to FIG. 4.

Thus, at the input of this device, a low-band excitation signal decoded or estimated by analysis is received (u(n)). The band extension here uses the excitation decoded at 12.8 kHz (exc2 or u(n)) at the output of the block 302.

It will be noted that, in this embodiment, the generation of the oversampled and extended excitation is performed in a frequency band ranging from 5 to 8 kHz therefore including a second frequency band (6.4-8 kHz) above the first frequency band (0-6.4 kHz).

Thus, the generation of an extended excitation signal is performed at least over the second frequency band but also over a part of the first frequency band.

Obviously, the values defining these frequency bands can be different depending on the decoder or the processing device in which the invention is applied.

For this exemplary embodiment, this signal is transformed to obtain an excitation signal spectrum U(k) by the time-frequency transformation module 500.

In a particular embodiment, the transform uses a DCT-IV (for "Discrete Cosine Transform"—type IV) (block 500) on the current frame of 20 ms (256 samples), without windowing, which amounts to directly transforming u(n) with n=0, . . . , 255 according to the following formula:

$$U(k) = \sum_{n=0}^{N-1} u(n)\cos\left(\frac{\pi}{N}\left(n+\frac{1}{2}\right)\left(k+\frac{1}{2}\right)\right)$$

as in which N=256 and k=0, . . . , 255.

It should be noted here that the transformation without windowing (or, equivalently, with an implicit rectangular window of the length of the frame) is possible because the processing is performed in the excitation domain, and not the signal domain so that no artifact (block effects) is audible, which constitutes an important advantage of this embodiment of the invention.

In this embodiment, the DCT-IV transformation is implemented by FFT according to the so-called "Evolved DCT (EDCT)" algorithm described in the article by D. M. Zhang, H. T. Li, *A Low Complexity Transform-Evolved DCT*, IEEE 14th International Conference on Computational Science and Engineering (CSE), August 2011, pp. 144-149, and implemented in the ITU-T standards G.718 Annex B and G.729.1 Annex E.

In variants of the invention, and without loss of generality, the DCT-IV transformation will be able to be replaced by other short-term time-frequency transformations of the same length and in the excitation domain, such as an FFT (for "Fast Fourier Transform") or a DCT-II (Discrete Cosine Transform-type II). Alternatively, it will be possible to replace the DCT-IV on the frame by a transformation with overlap-addition and windowing of length greater than the length of the current frame, for example by using an MDCT (for "Modified Discrete Cosine Transform"). In this case, the delay Tin the block 310 of FIG. 3 will have to be adjusted (reduced) appropriately as a function of the additional delay due to the analysis/synthesis by this transform.

The DCT spectrum, U(k), of 256 samples covering the 0-6400 Hz band (at 12.8 kHz), is then extended (block 501) into a spectrum of 320 samples covering the 0-8000 Hz band (at 16 kHz) in the following form:

$$U_{HB1}(k) = \begin{cases} 0 & k = 0, \cdots, 199 \\ U(k) & k = 200, \cdots, 239 \\ U(k + \text{start_band} - 240) & k = 240, \cdots, 319 \end{cases}$$

in which it is preferentially taken that start_band=160.

The block 501 operates as module for generating an oversampled and extended excitation signal and performs the step E401 comprising a re-sampling from 12.8 to 16 kHz in the frequency domain, by adding ¼ of samples (k=240, . . . , 319) to the spectrum, the ratio between 16 and 12.8 being 5/4.

Furthermore, the block 501 performs an implicit high-pass filtering in the 0-5000 Hz band since the first 200 samples of $U_{HB1}(k)$ are set to zero; as explained later, this high-pass filtering is also complemented by a part of progressive attenuation of the spectral values of indices k=200, . . . , 255 in the 5000-6400 Hz band; this progressive attenuation is implemented in the block 504 but could be performed separately outside of the block 504. Equivalently, and in variants of the invention, the implementation of the high-pass filtering separated into blocks of coefficients of index k=0, . . . , 199 set to zero, of attenuated coefficients k=200, . . . , 255 in the transformed domain, will therefore be able to be performed in a single step.

In this exemplary embodiment and according to the definition of $U_{HB1}(k)$, it will be noted that the 5000-6000 Hz band of $U_{HB1}(k)$ (which corresponds to the indices k=200, . . . , 239) is copied from the 5000-6000 Hz band of U(k). This approach makes it possible to retain the original spectrum in this band and avoids introducing distortions in the 5000-6000 Hz band upon the addition of the HF synthesis with the LF synthesis—in particular the phase of the signal (implicitly represented in the DCT-IV domain) in this band is preserved.

The 6000-8000 Hz band of $U_{HB1}(k)$ is here defined by copying the 4000-6000 Hz band of U(k) since the value of start_band is preferentially set at 160.

In a variant of the embodiment, the value of start_band will be able to be made adaptive around the value of 160, without modifying the nature of the invention. The details of the adaptation of the start_band value are not described here because they go beyond the framework of the invention without changing its scope.

For certain wide-band signals (sampled at 16 kHz), the high band (>6 kHz) may be noise-affected, harmonic or comprise a mixture of noise and harmonics. Furthermore, the level of harmonicity in the 6000-8000 Hz band is generally correlated with that of the lower frequency bands. Thus, in a particular embodiment, the noise generation block 502 implements the step E402 of FIG. 4 and performs a noise generation in the frequency domain, $U_{HBN}(k)$ for k=240, . . . , 319 (80 samples) corresponding to a second frequency band called high frequency in order to then combine this noise with the spectrum $U_{HB1}(k)$ in the block 503.

In a particular embodiment, the noise (in the 6000-8000 Hz band) is generated pseudo-randomly with a linear congruential generator on 16 bits:

$$U_{HBN}(k)=\begin{cases}0 & k=0,\cdots,239\\ 31821U_{HBN}(k-1)+13849 & k=240,\cdots,319\end{cases}$$

with the convention that $U_{HBN}(\mathbf{239})$ in the current frame corresponds to the value $U_{HBN}(\mathbf{319})$ of the preceding frame. In variants of the invention, it will be possible to replace this noise generation by other methods.

The combination block 503 can be produced in different ways. Preferentially, an adaptive additive mixing of the following form is considered:

$$U_{HB2}(k)=\beta U_{HB1}(k)+\alpha G_{HBN}U_{HBN}(k),k=240,\ldots,319$$

in which $G_{HBN}$ is a normalization factor serving to equalize the level of energy between the two signals, $$G_{HBN}=\sqrt{\frac{\sum_{k=240}^{319}U_{HB1}(k)^2+\varepsilon}{\sum_{k=240}^{319}U_{HBN}(k)^2+\varepsilon}}$$

with $\epsilon=0.01$, and the coefficient $\alpha$ (between 0 and 1) is adjusted as a function of parameters estimated from the decoded low band and the coefficient $\beta$ (between 0 and 1) depends on $\alpha$.

In a preferred embodiment, the energy of the noise is computed in three bands: 2000-4000 Hz, 4000-6000 Hz and 6000-8000 Hz, with $$E_{N2-4}=\sum_{k\in N(80,159)}U'^2(k)$$

$$E_{N4-6}=\sum_{k\in N(160,239)}U'^2(k)$$

$$E_{N4-6}=\sum_{k\in N(240,319)}U'^2(k)$$

in which $$U'(k)=\begin{cases}\sqrt{\frac{\sum_{k=160}^{239}U^2(k)}{\sum_{k=80}^{159}U^2(k)}}U(k) & k=80,\ldots,159\\ U(k) & k=160,\ldots,239\\ \sqrt{\frac{\sum_{k=160}^{239}U^2(k)}{\sum_{k=240}^{319}U_{HB1}^2(k)}}U_{HB1}(k) & k=240,\ldots,319\end{cases}$$

and $N(k_1, k_2)$ is the set of the indices k for which the coefficient of index k is classified as being associated with the noise. This set can, for example be obtained by detecting the local peaks in U'(k) that verify $|U'(k)|\geq|U'(k-1)|$ et $|U'(k+1)|$ and by considering that these rays are not associated with the noise, i.e. (by applying the negation of the preceding condition):

$$N(a,b)=\{a\leq k\leq b\,|\,|U'(k)|<|U'(k-1)|\,ou\,|U'(k)|<|U'(k+1)|\}$$

It can be noted that other methods for computing the energy of the noise are possible, for example by taking the median value of the spectrum on the band considered or by applying a smoothing to each frequency ray before computing the energy per band.

$\alpha$ is set such that the ratio between the energy of the noise in the 4-6 kHz and 6-8 kHz bands is the same as between the 2-4 kHz and 4-6 kHz bands:

$$\alpha=\sqrt{\frac{\rho-E_{N6-8}}{\sum_{k=160}^{239}U^2(k)-E_{N6-8}}}$$

in which $$E_{N4-6}=\max(E_{N4-6},E_{N2-4}),\ \rho=\frac{E_{N4-6}^2}{E_{N2-4}},\ \rho=\max(\rho,E_{N6-8})$$

in which max( . . . ) is the function which gives the maximum of the two arguments.

In variants of the invention, the computation of $\alpha$ will be able to be replaced by other methods. For example, in a variant, it will be possible to extract (compute) different parameters (or "features") characterizing the signal in low band, including a "tilt" parameter similar to that computed in the AMR-WB codec, and the factor $\alpha$ will be estimated as a function of a linear regression from these different parameters by limiting its value between 0 and 1. The linear regression will, for example, be able to be estimated in a supervised manner by estimating the factor $\alpha$ by exchanging the original high band in a learning base. It will be noted that the way in which $\alpha$ is computed does not limit the nature of the invention.

In a preferred embodiment, the following is taken $$\beta=\sqrt{1-\alpha^2}$$

in order to preserve the energy of the extended signal after mixing.

In a variant, the factors $\beta$ and $\alpha$ will be able to be adapted to take account of the fact that a noise injected into a given band of the signal is generally perceived as stronger than a harmonic signal with the same energy in the same band. Thus, it will be possible to modify the factors $\beta$ and a as follows:

$$\beta\leftarrow\beta\cdot f(\alpha)$$

$$\alpha\leftarrow\alpha\cdot f(\alpha)$$

in which $f(\alpha)$ is a decreasing function of $\alpha$, for example $f(\alpha)=b-\alpha\sqrt{\alpha}$, b=1.1, $\alpha$=1.2, $f(\alpha)$ limited from 0.3 to 1. It must be noted that, after multiplication by $f(\alpha)$, $\alpha^2+\beta^2<1$ so that the energy of the signal $U_{HB2}(k)=\beta U_{HB1}(k)+\alpha G_{HBN}U_{HBN}(k)$ is lower than the energy of $U_{HB1}(k)$ (the energy difference depends on $\alpha$, the more noise is added, the more the energy is attenuated).

In other variants of the invention, it will be possible to take:

$$\beta=1-\alpha$$

which makes it possible to preserve the amplitude level (when the combined signals are of the same sign); however, this variant has the disadvantage of resulting in an overall energy (at the level of $U_{HB2}(k)$) which is not monotonous as a function of $\alpha$.

Figure 1:
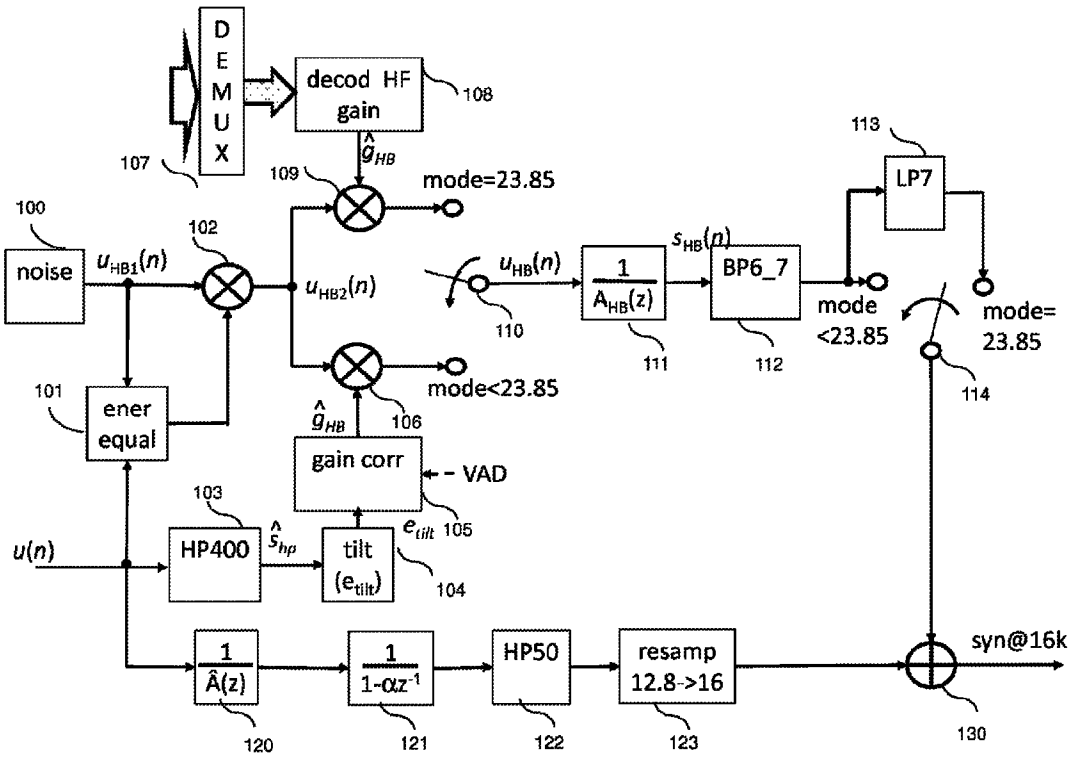
Fig.1 (Prior Art)
FIG. 1 illustrates a part of a decoder of AMR-WB type implementing frequency band extension steps of the prior art and as described previously.

It should therefore be noted here that the block 503 performs the equivalent of the block 101 of FIG. 1 to normalize the white noise as a function of an excitation which is, by contrast here, in the frequency domain, already extended to the rate of 16 kHz; furthermore, the mixing is limited to the 6000-8000 Hz band.

In a simple variant, it is possible to consider an implementation of the block 503, in which the spectra, $U_{HB1}(k)$ or $G_{HBN}U_{HBN}(k)$, are selected (switched) adaptively, which amounts to allowing only the values 0 or 1 for $\alpha$; this approach amounts to classifying the type of excitation to be generated in the 6000-8000 Hz band.

The block 504 optionally performs a double operation of application of bandpass filter frequency response and of de-emphasis filtering in the frequency domain.

In a variant of the invention, the de-emphasis filtering will be able to be performed in the time domain, after the block 505, even before the block 500; however, in this case, the bandpass filtering performed in the block 504 may leave certain low-frequency components of very low levels which are amplified by de-emphasis, which can modify, in a slightly perceptible manner, the decoded low band. For this reason, it is preferred here to perform the de-emphasis in the frequency domain. In the preferred embodiment, the coefficients of index k=0, . . . , 199 are set to zero, so the de-emphasis is limited to the higher coefficients. The excitation is first de-emphasized according to the following equation:

$$U'_{HB2}(k) = \begin{cases} 0 & k = 0, \cdots, 199 \\ G_{deemph}(k-200)U_{HB2}(k) & k = 200, \cdots, 255 \\ G_{deemph}(55)U_{HB2}(k) & k = 256, \cdots, 319 \end{cases}$$

in which $G_{deemph}(k)$ is the frequency response of the filter $1/(1-0.68z^{-1})$ over a restricted discrete frequency band. By taking into account the discrete (odd) frequencies of the DCT-IV, $G_{deemph}(k)$ is defined here as:

$$G_{deemph}(k) = \frac{1}{|e^{j\theta_k} - 0.68|}, k = 0, \cdots, 255$$

in which $$\theta_k = \frac{256 - 80 + k + \frac{1}{2}}{256}.$$

In the case where a transformation other than DCT-IV is used, the definition of $\theta_k$ will be able to be adjusted (for example for even frequencies).

It should be noted that the de-emphasis is applied in two phases for k=200, . . . , 255 corresponding to the 5000-6400 Hz frequency band, where the response $1/(1-0.68z^{-1})$ is applied as at 12.8 kHz, and for k=256, . . . , 319 corresponding to the 6400-8000 Hz frequency band, where the response is extended from 16 kHz here to a constant value in the 6.4-8 kHz band.

It can be noted that, in the AMR-WB codec, the HF synthesis is not de-emphasized. In the embodiment presented here, the high frequency signal is, on the contrary, de-emphasized so as to bring it into a domain consistent with the low frequency signal (0-6.4 kHz) which leaves from the block 305. This is important for the estimation and the subsequent adjustment of the energy of the HF synthesis.

In a variant of the embodiment, in order to reduce the complexity, it will be possible to set $G_{deemph}(k)$ at a constant value independent of k, by taking for example $G_{deemph}(k)$ =0.6 which corresponds approximately to the average value of $G_{deemph}(k)$ for k=200, . . . , 319 in the conditions of the embodiment described above.

In another variant of the embodiment of the extension device, the de-emphasis will be able to be performed in an equivalent manner in the time domain after inverse DCT. Such an embodiment is implemented in FIG. 7 described later.

In addition to the de-emphasis, a bandpass filtering is applied with two separate parts: one, high-pass, fixed, the other, low-pass, adaptive (function of the bit rate).

Figure 6:
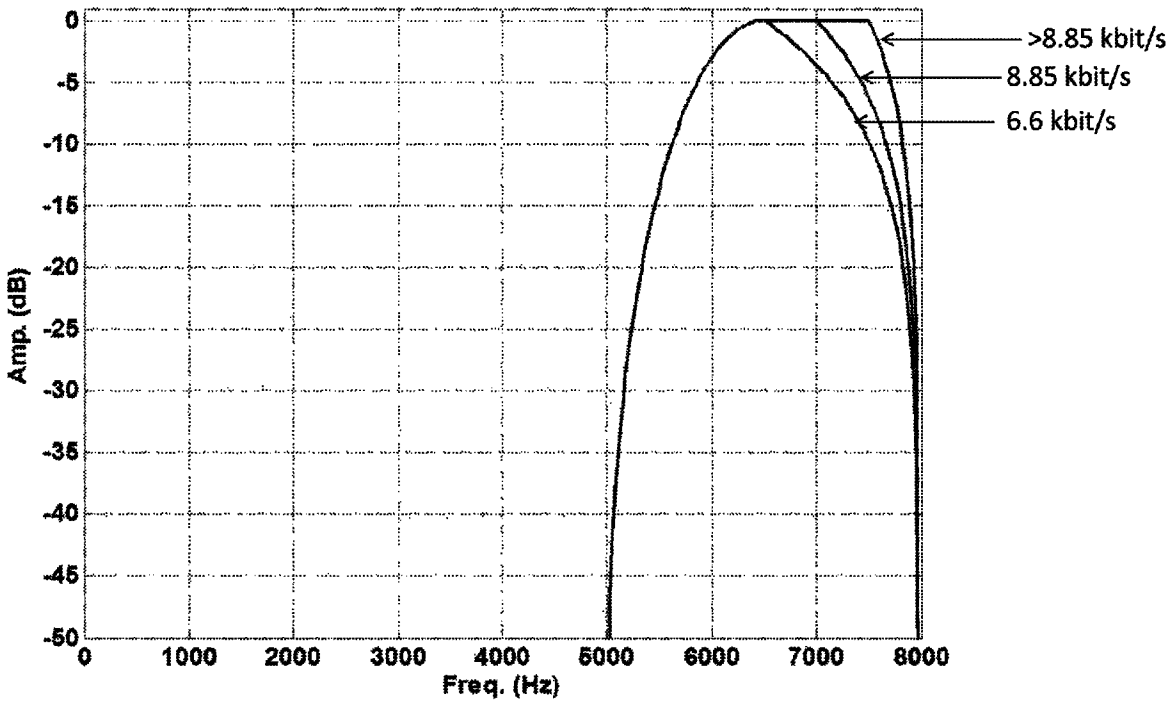
FIG. 6 illustrates an exemplary frequency response of a bandpass filter used in a particular embodiment of the invention.

This filtering is performed in the frequency domain, and its frequency response is illustrated in FIG. 6. The cut-off frequencies at 3 dB are 6000 Hz for the low part and for the high part approximately 6900, 7300, 7600 Hz at 6.6, 8.86 and at the bit rates higher than 8.85 kbit/s (respectively).

In the preferred embodiment, the low-pass filter partial response is computed in the frequency domain as follows:

$$G_{lp}(k) = 1 - 0.999\frac{k}{N_{lp} - 1}$$

in which $N_{lp}$=60 at 6.6 kbit/s, 40 at 8.85 kbit/s, and 20 at the bit rates >8.85 bit/s. Then, a bandpass filter is applied in the form:

$$U_{HB3}(k) = \begin{cases} 0 & k = 0, \cdots, 199 \\ G_{hp}(k-200)U'_{HB2}(k) & k = 200, \cdots, 255 \\ U'_{HB2}(k) & k = 256, \cdots, 319 - N_{lp} \\ G_{lp}(k - 320 - N_{lp})U'_{HB2}(k) & k = 320 - N_{lp}, \cdots, 319 \end{cases}$$

The definition of $G_{hp}(k)$, k=0, . . . , 55, is given, for example, in table 1 below.

TABLE 1

| K | $g_{hp}(k)$ |
|---|---|
| 0 | 0.001622428 |
| 1 | 0.004717458 |
| 2 | 0.008410494 |
| 3 | 0.012747280 |
| 4 | 0.017772424 |
| 5 | 0.023528982 |
| 6 | 0.030058032 |
| 7 | 0.037398264 |
| 8 | 0.045585564 |
| 9 | 0.054652620 |
| 10 | 0.064628539 |
| 11 | 0.075538482 |
| 12 | 0.087403328 |
| 13 | 0.100239356 |
| 14 | 0.114057967 |
| 15 | 0.128865425 |
| 16 | 0.144662643 |
| 17 | 0.161445005 |
| 18 | 0.179202219 |
| 19 | 0.197918220 |
| 20 | 0.217571104 |
| 21 | 0.238133114 |
| 22 | 0.259570657 |
| 23 | 0.281844373 |
| 24 | 0.304909235 |
| 25 | 0.328714699 |
| 26 | 0.353204886 |
| 27 | 0.378318805 |
| 28 | 0.403990611 |
| 29 | 0.430149896 |
| 30 | 0.456722014 |
| 31 | 0.483628433 |

TABLE 1-continued

| K | $g_{hp}(k)$ |
|---|---|
| 32 | 0.510787115 |
| 33 | 0.538112915 |
| 34 | 0.565518011 |
| 35 | 0.592912340 |
| 36 | 0.620204057 |
| 37 | 0.647300005 |
| 38 | 0.674106188 |
| 39 | 0.700528260 |
| 40 | 0.726472003 |
| 41 | 0.751843820 |
| 42 | 0.776551214 |
| 43 | 0.800503267 |
| 44 | 0.823611104 |
| 45 | 0.845788355 |
| 46 | 0.866951597 |
| 47 | 0.887020781 |
| 48 | 0.905919644 |
| 49 | 0.923576092 |
| 50 | 0.939922577 |
| 51 | 0.954896429 |
| 52 | 0.968440179 |
| 53 | 0.980501849 |
| 54 | 0.991035206 |
| 55 | 1.000000000 |

It will be noted that, in variants of the invention, the values of $G_{hp}(k)$ will be able to be modified while keeping a progressive attenuation. Similarly, the low-pass filtering with variable bandwidth, $G_{lp}(k)$, will be able to be adjusted with values or a frequency medium that are different, without changing the principle of this filtering step.

It will also be noted that the example of bandpass filtering illustrated in FIG. 6 will be able to be adapted by defining a single filtering step combining the high-pass and low-pass filterings.

In another embodiment, the bandpass filtering will be able to be performed in an equivalent manner in the time domain (as in the block 112 of FIG. 1) with different filter coefficients according to the bit rate, after an inverse DCT step. Such an embodiment is implemented in FIG. 7 described later. However, it will be noted that it is advantageous to perform this step directly in the frequency domain because the filtering is performed in the domain of the LPC excitation and therefore the problems of circular convolution and of edge effects are very limited in this domain.

The inverse transform block 505 performs an inverse DCT on 320 samples to find the high-frequency excitation sampled at 16 kHz. Its implementation is identical to the block 500, because the DCT-IV is orthonormal, except that the length of the transform is 320 instead of 256, and the following is obtained:

$$u_{HB}(n) = \sum_{k=0}^{N_{16k}-1} U_{HB3}(k)\cos\left(\frac{\pi}{N_{16k}}\left(k+\frac{1}{2}\right)\left(n+\frac{1}{2}\right)\right)$$

in which $N_{16k} = 320$ and $k = 0, \cdots, 319$.

This excitation sampled at 16 kHz is then, optionally, scaled by gains defined per sub-frame of 80 samples (block 507).

In a preferred embodiment, a gain $g_{HB1}(m)$ is first computed (block 506) per sub-frame by ratios of energy of the sub-frames such that, in each sub-frame of index m=0, 1, 2 or 3 of the current frame:

$$g_{HB1}(m) = \sqrt{\frac{e_3(m)}{e_2(m)}}$$

in which $$e_1(m) = \sum_{n=0}^{63} u(n+64m)^2 + \varepsilon$$

$$e_2(m) = \sum_{n=0}^{79} u_{HB}(n+80m)^2 + \varepsilon$$

$$e_3(m) = e_1(m)\frac{\sum_{n=0}^{319} u_{HB}(n)^2 + \varepsilon}{\sum_{n=0}^{255} u(n)^2 + \varepsilon}$$

with $\epsilon$=0.01. The gain per sub-frame $g_{HB1}(m)$ can be written in the form:

$$g_{HB1}(m) = \sqrt{\frac{\frac{\sum_{n=0}^{63} u(n+64m)^2 + \varepsilon}{\sum_{n=0}^{255} u(n)^2 + \varepsilon}}{\frac{\sum_{n=0}^{79} u_{HB}(n+80m)^2 + \varepsilon}{\sum_{n=0}^{319} u_{HB}(n)^2 + \varepsilon}}}$$

which shows that, in the signal $u_{HB}$, the same ratio between energy per sub-frame and energy per frame as in the signal u(n) is assured.

The block 507 performs the scaling of the combined (or extended) signal (step E406 of FIG. 4) according to the following equation:

$$u_{HB}'(n)=g_{HB1}(m)u_{HB}(n), n=80m, \ldots, 80(m+1)-1$$

It will be noted that the implementation of the block 506 differs from that of the block 101 of FIG. 1, because the energy at the current frame level is taken into account in addition to that of the sub-frame. This makes it possible to have the ratio of the energy of each sub-frame in relation to the energy of the frame. Ratios of energy (or relative energies) are therefore compared rather than the absolute energies between low band and high band.

Thus, this scaling step makes it possible to retain, in the high band, the ratio of energy between the sub-frame and the frame in the same way as in the low band.

Optionally, the block 509 then performs the scaling of the signal (step E407 of FIG. 4) according to the following equation:

$$u_{HB}''(n)=g_{HB2}(m)u_{HB}'(n), n=80m, \ldots, 80(m+1)-1$$

in which the gain $g_{HB2}(m)$ is obtained from the block 508 by executing the blocks 103, 104 and 105 of the AMR-WB codec (the input of the block 103 being the excitation decoded in low band, u(n)). The blocks 508 and 509 are useful for adjusting the level of the LPC synthesis filter (block 510), here as a function of the tilt of the signal. Other methods for computing the gain $g_{HB2}(m)$ are possible without changing the nature of the invention.

Finally, the excitation, $u_{HB}'(n)$ or $u_{HB}''(n)$ is filtered (step E404 of FIG. 4) by the filtering module 510 which can be performed here by taking as transfer function $1/\hat{A}(z/\gamma)$, in which $\gamma=0.9$ at 6.6 kbit/s and $\gamma=0.6$ at the other bit rates, which limits the order of the filter to the order 16.

In a variant, this filtering will be able to be performed in the same way as is described for the block 111 of FIG. 1 of the AMR-WB decoder, but the order of the filter changes to 20 at the 6.6 bit rate, which does not significantly change the quality of the synthesized signal. In another variant, it will be possible to perform the LPC synthesis filtering in the frequency domain, after having computed the frequency response of the filter implemented in the block 510.

In variant embodiments of the invention, the coding of the low band (0-6.4 kHz) will be able to be replaced by a CELP coder other than that used in AMR-WB, such as, for example, the CELP coder in G.718 at 8 kbit/s. With no loss of generality, other wide-band coders or coders operating at frequencies above 16 kHz, in which the coding of the low band operates with an internal frequency at 12.8 kHz, could be used. Moreover, the invention can obviously be adapted to sampling frequencies other than 12.8 kHz, when a low-frequency coder operates with a sampling frequency lower than that of the original or reconstructed signal. When the low-band decoding does not use linear prediction, there is no excitation signal to be extended, in which case it will be possible to perform an LPC analysis of the signal reconstructed in the current frame and an LPC excitation will be computed so as to be able to apply the invention.

Finally, in another variant of the invention, the excitation (u(n)) is resampled, for example by linear interpolation or cubic "spline", from 12.8 to 16 kHz before transformation (for example DCT-IV) of length 320. This variant has the defect of being more complex, because the transform (DCT-IV) of the excitation is then computed over a greater length and the re-sampling is not performed in the transform domain.

Furthermore, in variants of the invention, all the computations necessary for the estimation of the gains ($G_{HBN}$, $g_{HB1}(m)$, $g_{HB2}(m)$, $g_{HBN}$, . . . ) will be able to be performed in a logarithmic domain.

Referring to FIG. 7, a second embodiment of the band extension device is now described. This embodiment operates in the time domain.

As in the embodiment of FIG. 5, the principle of the embodiment with mixing of an extended signal at 16 kHz and a noise signal is retained, but this mixing is this time performed in the time domain and this time the main generation of the excitation is done per sub-frame and not per frame.

The excitation signal u(n), n=0, . . . , 255, from the low-frequency decoding in the current frame is first resampled without delay (step E401 of FIG. 4) at 16 kHz (block 700) and, in a particular embodiment, a linear interpolation is used to obtain the extended excitation signal in a second frequency band, $u_{ext}(n)$, n=0, . . . , 319. In a variant embodiment, it will be possible to use other re-sampling methods, for example by "splines" or by multi-rate filtering.

A check is carried out to ensure that the energy of the signal $u_{ext}(n)$ has a level to similar to the excitation u(n) with the blocks 701 and 702 as follows:

$$u'_{ext}(n) = u_{ext}(n)\sqrt{\frac{\sum_{l=0}^{63} u(l)^2}{\sum_{l=0}^{79} u_{ext}(l)^2}}$$

In a variant embodiment, it will be possible to multiply $u'_{ext}(n)$ by 5/4 to compensate the attenuation by the ratio 12.8/16, caused by different signal sampling frequencies $u_{ext}(n)$ and u(n).

The noise generator in the block 703 implements the step E402 of FIG. 4 and can be implemented as in the block 502 described in FIG. 5, except that the signal at the output corresponds to a temporal sub-frame, $u_{HBN}(n)$, n=0, . . . , 319.

The combination block 704 can be produced in different ways. Preferentially, an adaptive additive mixing per sub-frame is considered, in the form:

$$u_{HB1}(n+80m)=\beta u_{ext}(n+80m)+\alpha g_{HBN} u_{HBN}(n+80m),\quad n=0, \ldots ,79$$

in which $g_{HBN}$ is a normalization factor serving to equalize the level of harmonicity of the two combined signals, $$g_{HBN} = \sqrt{\frac{\sum_{k=0}^{79} u_{ext}(n)^2 + \varepsilon}{\sum_{k=0}^{79} u_{HBN}(n)^2 + \varepsilon}}$$

and m is the index of the sub-frame and the factors $\alpha$ and $\beta$ are computed as in the first embodiment. It will therefore be noted here that the block 704 performs the equivalent of the block 101 of FIG. 1. In addition, the computation of the factor $\alpha$ entails computing the transform of the decoded excitation signal (or the decoded signal itself according to the computation domain of the relative level of noise or of spectral flatness) in low band if this computation relies on the spectral flatness; in variants, including the use of a linear regression described previously, such a transform is not necessary.

Then, the temporal signal is de-emphasized (block 705) by a filter of the form $g_{deemph}/(1-0.68z^{-1})$, in which $g_{deemph}$ is computed so as to prolong the filter $1/(1-0.68z^{-1})$ (defined at 12.8 kHz) to the sampling frequency of 16 kHz $g_{deemph}=|(1-0.68e^{j2\pi 6000/16000})/(1-0.68e^{j2\pi 6000/13800})$, then processed by a bandpass filtering of variable bandwidth (block 706) the order of which is fixed (of value 30) but the coefficients of which change as a function of the decoded bit rate of the current frame. An exemplary embodiment of such an adaptive bandpass filtering of FIR type is given in the tables below defining the impulse response of the FIR filter according to the bit rate.

TABLE 2a (6.6 kbit/s)

| n | h(n) | N | h(n) | N | h(n) | N | h(n) |
|---|---|---|---|---|---|---|---|
| 0 | −0.0002581 | 8 | 0.0306285 | 16 | −0.1451668 | 24 | −0.0114595 |
| 1 | 0.0003791 | 9 | −0.0716116 | 17 | 0.0626279 | 25 | 0.0090482 |
| 2 | 0.0002581 | 10 | 0.0995869 | 18 | 0.0286124 | 26 | −0.0029758 |
| 3 | −0.0002177 | 11 | −0.0885791 | 19 | −0.0885791 | 27 | −0.0002177 |
| 4 | −0.0029758 | 12 | 0.0286124 | 20 | 0.0995869 | 28 | 0.0002581 |
| 5 | 0.0090482 | 13 | 0.0626279 | 21 | −0.0716116 | 29 | 0.0003791 |
| 6 | −0.0114595 | 14 | −0.1451668 | 22 | 0.0306285 | 30 | −0.0002581 |
| 7 | 0 | 15 | 0.1783678 | 23 | 0 | — | — |

TABLE 2b

| (8.85 kbit/s) | |
|---|---|
| n | h(n) |
| 0 | 0.0019706 |
| 1 | −0.0064291 |
| 2 | 0.0124179 |
| 3 | −0.0160589 |
| 4 | 0.0132058 |
| 5 | −0.0041966 |
| 6 | −0.0030672 |
| 7 | −0.0036671 |
| 8 | 0.0312161 |
| 9 | −0.0709664 |
| 10 | 0.0980678 |
| 11 | −0.0842625 |
| 12 | 0.0181018 |
| 13 | 0.0817478 |
| 14 | −0.1720177 |
| 15 | 0.2083360 |
| 16 | −0.1720177 |
| 17 | 0.0817478 |
| 18 | 0.0181018 |
| 19 | −0.0842625 |
| 20 | 0.0980678 |
| 21 | −0.0709664 |
| 22 | 0.0312161 |
| 23 | −0.0036671 |
| 24 | −0.0030672 |
| 25 | −0.0041966 |
| 26 | 0.0132058 |
| 27 | −0.0160589 |
| 28 | 0.0124179 |
| 29 | −0.0064291 |
| 30 | 0.0019706 |
| — | |

TABLE 2c

| (bit rates > 8.85 kbit/s) | |
|---|---|
| n | h(n) |
| 0 | 0.0013312 |
| 1 | −0.0047346 |
| 2 | 0.0098657 |
| 3 | −0.0147045 |
| 4 | 0.0171709 |
| 5 | −0.0180046 |
| 6 | 0.0221682 |
| 7 | −0.0360130 |
| 8 | 0.0606146 |
| 9 | −0.0860005 |
| 10 | 0.0924138 |
| 11 | −0.0607694 |
| 12 | −0.0129187 |
| 13 | 0.1093354 |
| 14 | −0.1916778 |
| 15 | 0.2240719 |
| 16 | −0.1916778 |
| 17 | 0.1093354 |
| 18 | −0.0129187 |
| 19 | −0.0607694 |
| 20 | 0.0924138 |
| 21 | −0.0860005 |
| 22 | 0.0606146 |
| 23 | −0.0360130 |
| 24 | 0.0221682 |
| 25 | −0.0180046 |
| 26 | 0.0171709 |
| 27 | −0.0147045 |
| 28 | 0.0098657 |
| 29 | −0.0047346 |
| 30 | 0.0013312 |
| — | — |

The scaling step (E407 in FIG. 4) is performed by the blocks 508 and 509 identical to FIG. 5.

The filtering step (E404 of FIG. 4) is performed by the filtering module (block 510) identical to that described with reference to FIG. 5.

It is unnecessary here to implement a scaling step as performed in the embodiment of FIG. 5 by the blocks 506 and 507 since the excitation is generated per sub-frames. The consistency of the energy ratio at the frame level is already assured.

In variants of the band extension, the excitation in low band u(n) and the LPC filter $1/\hat{A}(z)$ will be estimated per frame, by LPC analysis of a low-band signal for which the band has to be extended. The low-band excitation signal is then extracted by analysis of the audio signal.

In a possible embodiment of this variant, the low-band audio signal is resampled before the step of extracting the excitation, so that the excitation extracted from the audio is signal (by linear prediction) is already resampled.

The invention illustrated in FIG. 5, or alternatively in FIG. 7, is applied in this case to a low band which is not decoded but analyzed.

Figure 8:
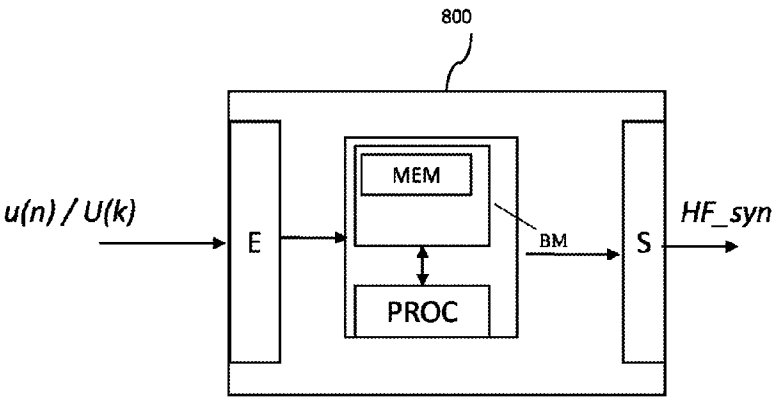
FIG. 8 illustrates a hardware implementation of a band extension device according to the invention.

FIG. 8 represents an exemplary physical embodiment of a band extension device 800 according to the invention. The latter can form an integral part of an audio frequency signal decoder or of an equipment item receiving audio frequency signals, decoded or not.

This type of device comprises a processor PROC cooperating with a memory block BM comprising a storage and/or working memory MEM.

Such a device comprises an input module E suitable for receiving an excitation audio signal decoded or extracted in a first frequency band called low band (u(n) or U(k)) and the parameters of a linear prediction synthesis filter ($\hat{A}(z)$). It comprises an output module S suitable for transmitting the synthesized high-frequency signal (HF_syn) for example to a module for applying a delay like the block 310 of FIG. 3 or to a re-sampling module like the module 311.

The memory block can advantageously comprise a computer program comprising code instructions for implementing the steps of the band extension method within the meaning of the invention, when these instructions are executed by the processor PROC, and notably the steps of obtaining an extended signal in at least one second frequency band higher than the first frequency band from an excitation signal oversampled and extended in at least one second frequency band, of scaling of the extended signal by a gain defined per sub-frame as a function of a ratio of energy of a frame and of a sub-frame and of filtering of said scaled extended signal by a linear prediction filter whose coefficients are derived from the coefficients of the low-band filter.

Typically, the description of FIG. 4 reprises the steps of an algorithm of such a computer program. The computer program can also be stored on a memory medium that can be read by a reader of the device or that can be downloaded into the memory space thereof.

The memory MEM stores, generally, all the data necessary for the implementation of the method.

In one possible embodiment, the device which is thus described can also comprise low-band decoding functions and other processing functions described for example in FIG. 3 in addition to the band extension functions according to the invention.

The invention claimed is:

1. A frequency band extending method applied to an audio frequency signal in a decoding process comprising an act of decoding or an enhancement process comprising an act of extraction, in a first frequency band called low band, of an excitation signal and coefficients of a linear prediction filter, wherein the method comprises:

obtaining of an extended signal from an oversampled and extended excitation signal in at least one second frequency band higher than the first frequency band generated according to the following equation:

$$U_{HB1}(k) = \begin{cases} 0 & k = 0, \cdots, 199 \\ U(k) & k = 200, \cdots, 239 \\ U(k + \text{start_band} - 240) & k = 240, \cdots, 319 \end{cases}$$

with k being an index of a signal sample, $U_{HB1}$ (k) being a spectrum of the extended excitation signal, U(k) being a spectrum of the excitation signal obtained after a time-frequency transform act and start_band being a predefined variable;

scaling of the extended signal by a gain defined per sub-frame using a calculation based on a comparison between the extended signal and the low-band signal of a ratio of energy per sub-frame and energy per frame so that the extended signal has the same ratio of energy between a sub-frame and a frame as in the low-band signal;

filtering of said scaled extended signal by a linear prediction filter whose coefficients are derived from decoded or extracted coefficients of a linear prediction filter in the low-band.

2. The method as claimed in claim 1, wherein the method further comprises an adaptive bandpass filtering as a function of decoding bit rate of a current frame.

3. The method as claimed in claim 2, further comprising a de-emphasis filtering of the extended signal at least in the second frequency band.

4. The method as claimed in claim 1, wherein the method comprises a time-frequency transform of a time excitation signal, the act of obtaining of an extended signal then being performed in the frequency domain and an inverse time-frequency transform of the obtained extended signal before the scaling and filtering steps.

5. The method as claimed in claim 4, further comprising a de-emphasis filtering of the extended signal at least in the second frequency band.

6. The method as claimed in claim 1, wherein the method comprises a de-emphasis filtering of the extended signal at least in the second frequency band.

7. The method as claimed in claim 1, wherein the method further comprises a generation of a noise signal at least in the second frequency band, the extended signal being obtained by combination of the extended excitation signal and of the noise signal.

8. The method as claimed in claim 7, wherein the combination is performed by adaptive additive mixing with a level equalization gain between the extended excitation signal and the noise signal.

9. A frequency band extending device for extending the frequency band of an audio frequency signal comprising a decoding module for decoding or an extraction module for extracting, in a first frequency band called low band, an excitation signal and coefficients of a linear prediction filter, wherein the device comprises:

a module for obtaining an extended signal from an oversampled and extended excitation signal in at least one second frequency band higher than the first frequency band generated according to the following equation:

$$U_{HB1}(k) = \begin{cases} 0 & k = 0, \cdots, 199 \\ U(k) & k = 200, \cdots, 239 \\ U(k + \text{start_band} - 240) & k = 240, \cdots, 319 \end{cases}$$

with k being an index of a signal sample, $U_{HB1}$ (k) being a spectrum of the extended excitation signal, U(k) being a spectrum of the excitation signal obtained after a time-frequency transform act and start_band being a predefined variable;

a module for scaling the extended signal by a gain defined per sub-frame using a calculation based on a comparison between the extended signal and the low-band signal of a ratio of energy per sub-frame and energy per frame so that the extended signal has the same ratio of energy between a sub-frame and a frame as in the low-band signal;

a module for filtering said scaled extended signal by a linear prediction filter whose coefficients are derived from decoded or extracted coefficients of a linear prediction filter in the low-band.

10. An audio frequency signal decoder, comprising a frequency band extension device for extending the frequency band of an audio frequency signal comprising a decoding module for decoding or an extraction module for extracting, in a first frequency band called low band, an excitation signal and coefficients of a linear prediction filter, wherein the device comprises:

a module for obtaining an extended signal from an oversampled and extended excitation signal in at least one second frequency band higher than the first frequency band generated according to the following equation:

$$U_{HB1}(k) = \begin{cases} 0 & k = 0, \cdots, 199 \\ U(k) & k = 200, \cdots, 239 \\ U(k + \text{start_band} - 240) & k = 240, \cdots, 319 \end{cases}$$

with k being an index of a signal sample, $U_{HB1}$ (k) being a spectrum of the extended excitation signal, U(k) being a spectrum of the excitation signal obtained after a time-frequency transform act and start_band being a predefined variable;

a module for scaling the extended signal by a gain defined per sub-frame using a calculation based on a comparison between the extended signal and the low-band signal of a ratio of energy per sub-frame and energy per frame so that the extended signal has the same ratio of energy between a sub-frame and a frame as in the low-band signal;

a module for filtering said scaled extended signal by a linear prediction filter whose coefficients are derived from decoded or extracted coefficients of a linear prediction filter in the low-band.

11. A non-transitory storage medium that can be read by a frequency band extending device for extending the frequency band of an audio frequency signal on which is stored a computer program comprising code instructions for execution of a frequency band extending method, the method for extending the frequency band applied to an audio frequency signal in a decoding process comprising an act of decoding or an enhancement process comprising an act of extraction, in a first frequency band called low band, of an excitation signal and coefficients of a linear prediction filter, wherein the method comprises:

obtaining of an extended signal from an oversampled and extended excitation signal in the at least one second frequency band higher than the first frequency band generated according to the following equation:

$$U_{HB1}(k) = \begin{cases} 0 & k = 0, \cdots, 199 \\ U(k) & k = 200, \cdots, 239 \\ U(k + \text{start_band} - 240) & k = 240, \cdots, 319 \end{cases}$$

with k being an index of a signal sample, $U_{HB1}$ (k) being a spectrum of the extended excitation signal, U(k) being a spectrum of the excitation signal obtained after a time-frequency transform act and start_band being a predefined variable;

scaling of the extended signal by a gain defined per sub-frame using a calculation based on a comparison between the extended signal and the low-band signal of a ratio of energy per sub-frame and energy per frame so that the extended signal has the same ratio of energy between a sub-frame and a frame as in the low-band signal;

filtering of said scaled extended signal by a linear prediction filter whose coefficients are derived from decoded or extracted coefficients of a linear prediction filter in the low-band.

* * * * *